US007541555B2

(12) United States Patent
Chang

(10) Patent No.: US 7,541,555 B2
(45) Date of Patent: Jun. 2, 2009

(54) METHOD AND APPARATUS FOR DUAL MODE SWITCH

(75) Inventor: Lorrin E. N. Chang, Seattle, WA (US)

(73) Assignee: Korry Electronics Co., Seattle, WA (US)

( * ) Notice: Subject to any disclaimer, the term of this patent is extended or adjusted under 35 U.S.C. 154(b) by 386 days.

(21) Appl. No.: 11/114,309

(22) Filed: Apr. 25, 2005

(65) Prior Publication Data

US 2006/0237298 A1 Oct. 26, 2006

(51) Int. Cl.
*H01H 3/42* (2006.01)

(52) U.S. Cl. ..... 200/524; 200/529

(58) Field of Classification Search ..... 200/524
See application file for complete search history.

(56) References Cited

U.S. PATENT DOCUMENTS

| | | | | |
|---|---|---|---|---|
| 5,294,900 | A | 3/1994 | Mohabbatizadeh et al. | 335/20 |
| 5,641,060 | A * | 6/1997 | Tracey | 200/526 |
| 5,752,764 | A * | 5/1998 | Shiau | 362/206 |
| 6,069,545 | A * | 5/2000 | Van Zeeland | 335/207 |
| 6,097,272 | A * | 8/2000 | Grover et al. | 335/207 |
| 6,693,248 | B1 * | 2/2004 | Schultz | 200/11 TC |

* cited by examiner

*Primary Examiner*—Elvin G Enad
*Assistant Examiner*—Lheiren Mae A Anglo
(74) *Attorney, Agent, or Firm*—Seed Intellectual Property Law Group PLLC

(57) ABSTRACT

A dual mode switch is provided in accordance with the present invention. The switch is selectively and mechanically cycled between a first state and a second state while power is provided to a biasing member. The switch is selectively cycled from the second state to the first state by stopping the supply of power to the biasing member.

24 Claims, 7 Drawing Sheets

METHOD AND APPARATUS FOR DUAL MODE SWITCH

BACKGROUND OF THE INVENTION

1. Field of the Invention

The present invention generally relates to switches, and more particularly, to push button switches.

2. Description of the Related Art

Switch assemblies are commonly used to control a variety of electrical or hydraulic systems, for example in a vehicle such as an airplane or helicopter. Such switches are commonly mounted in a control panel provided in the cockpit of the vehicle, to be selectively actuated by a user, for example by pushing a button provided on the switch. Such push button switches are typically toggled between a first state and a second state by the user selectively pushing the button provided on the switch. Applicant believes that in many applications, it would be desirable to provide an alternate method for cycling the switch from one state to the other. While applicant is aware of one such attempt in the prior art, namely, U.S. Pat. No. 5,294,900, applicant believes that it is possible and desirable to produce a switch that is more reliable and that provides improved results over previous attempts to provide a dual mode switch assembly.

BRIEF SUMMARY OF THE INVENTION

Briefly, the present invention provides a dual mode switch assembly, that is selectively and mechanically cycled by a user between a first state and a second state, the switch being selectively cycled from the second state to the first state mechanically or electrically. This provides several advantages over prior art switches that are only mechanically activated and deactivated. For example, if the switch is provided in a helicopter, while a pilot may choose to cycle the switch to an "off" position mechanically, he may also rely on the fact that when the helicopter is powered down, the switch is reset. Compared to relatively complex attempts in the prior art to provide a switch that may be deactivated electronically, the present invention provides a switch that is simple and robust, thereby improving the reliability of the switch.

More particularly, in one embodiment of the invention, power is supplied to a biasing element to enable an actuation assembly coupled to a switch mechanism. The actuation assembly is mechanically engaged to selectively cycle the switch between a first state and a second state while maintaining the supply of power to the biasing element. When the supply of power to the biasing element is stopped, the switch is cycled from the second state to the first state.

In one embodiment, a translating cam is selectively movable between a first position and a second position adjacent a stationary cam. A biasing member is selectively movable between a first deactivated position and a second activated position. The biasing member holds the translating cam in the second position adjacent the stationary cam to form a sleeve, when the biasing member is in the second activated position. In one embodiment, the biasing member is a solenoid, a plunger of the solenoid seating against the translating cam and holding it in position adjacent the stationary cam when power is provided to the solenoid. When the supply of power to the solenoid is stopped, the plunger of the solenoid is released from engagement with the translating cam, and a spring coupled to the translating cam assists the return of the translating cam to its first position.

A plurality of teeth are provided in an inner region of the translating cam, the teeth being in an operable position when the translating cam is held in its second position adjacent the stationary cam. A cam assembly is-coupled to the sleeve and to a switch mechanism. Teeth provided on the cam assembly selectively engage the teeth in the sleeve to cycle the switch between a first state and a second state, as is known in the art.

DETAILED DESCRIPTION OF THE INVENTION

In the following description, certain specific details are set forth in order to provide a thorough understanding of various embodiments of the invention. However, one skilled in the relevant art will recognize that the invention may be practiced without one or more of these specific details, or with other methods, components, materials, etc.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
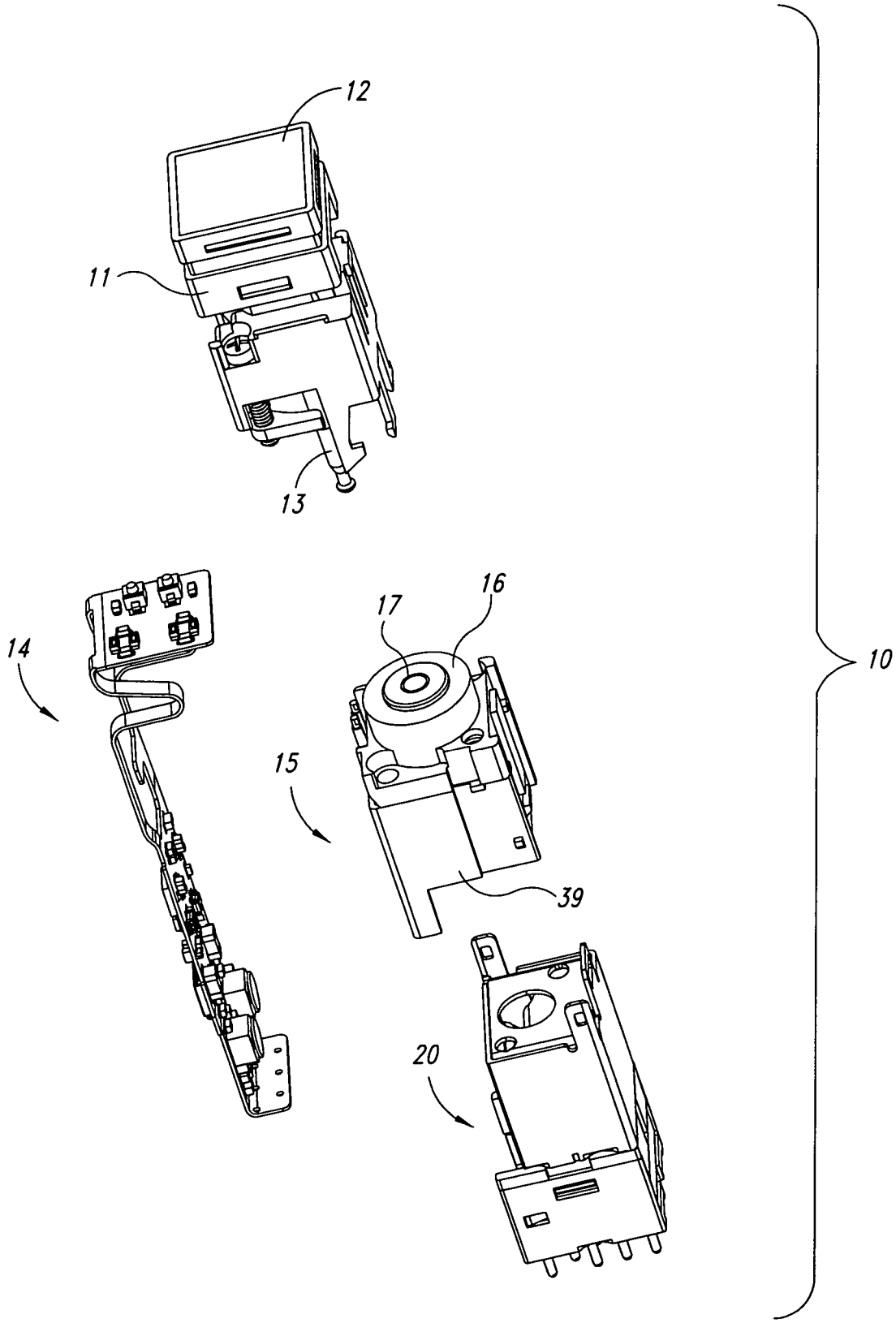
FIG. 1 is an exploded isometric view of a switch assembly provided in accordance with the present invention.

A dual mode switch is provided in accordance with the present invention. In one embodiment, as illustrated in FIG. 1, the switch 10 includes several subassemblies, namely, cap assembly 11, circuit card assembly 14, actuation assembly 15, and basic switch assembly 20. The circuit card assembly 14 may have any available configuration as is known in the art, and will therefore not be discussed in any further detail.

The switch 10 is a push button switch, which may be mechanically cycled between a first state and a second state, similar to conventional push button switches. However, unlike conventional switches, the switch 10 may also be cycled from the second state to the first state by deactivation of a biasing member, for example a solenoid.

Figure 2:
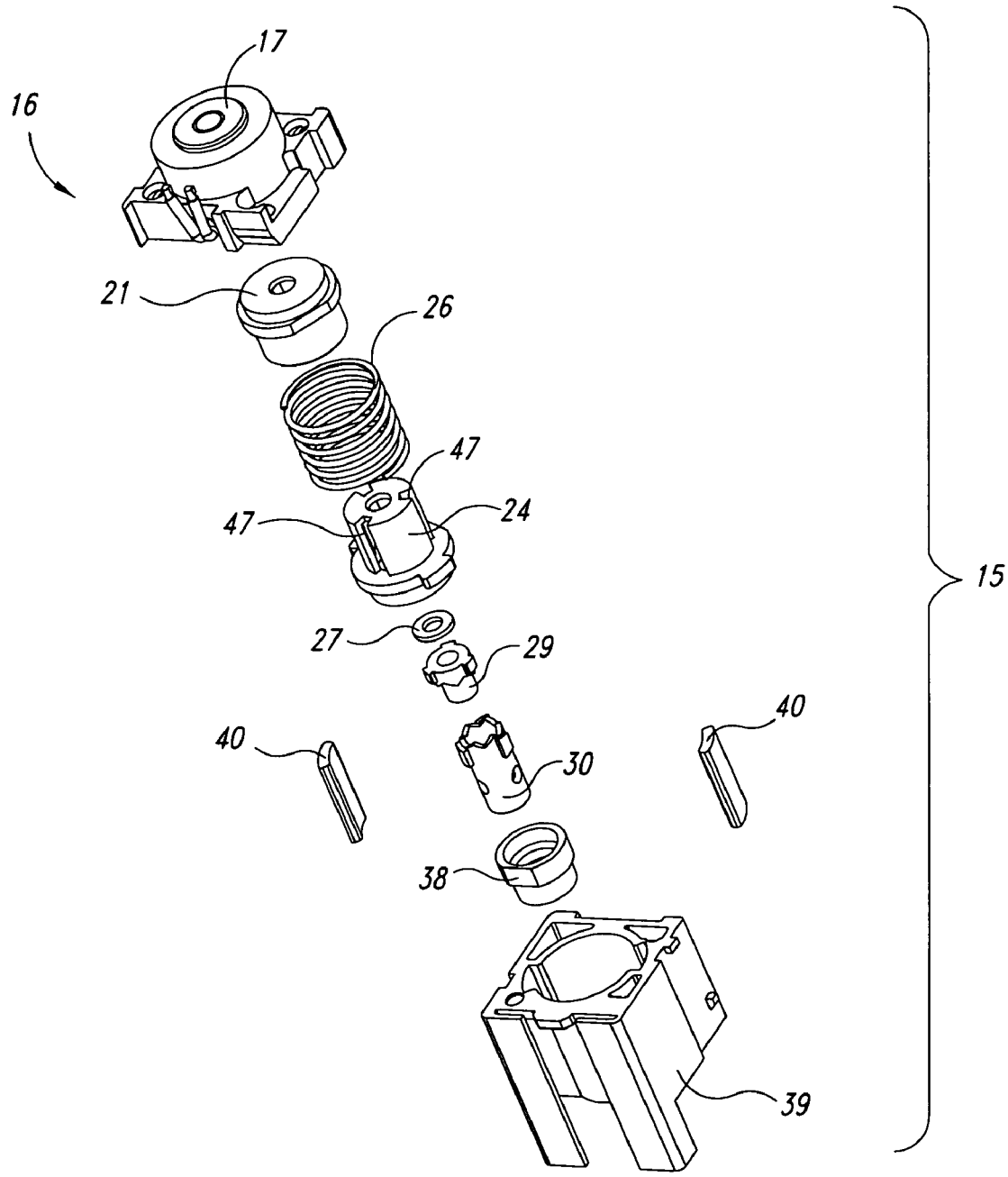
FIG. 2 is an exploded isometric view of an actuation assembly provided in accordance with the present invention.

As illustrated in FIG. 2, the actuation assembly 15 includes a solenoid or biasing member 16, a translating cam 21 that is selectively moved in and out of engagement with a stationary cam 24, and a spring 26 provided between the translating cam 21 and stationary cam 24 to restore the translating cam 21 to a first position when the biasing member is deactivated. A cam assembly comprising a guide cam 29, actuating cam 30 and washer 27 is positioned within the stationary cam 24, the cam assembly being selectively actuated via mechanical means to cycle the switch 10 between a first state and a second state, as will be discussed in greater detail below. The elements described above and a ball retainer 38 are maintained within a lower housing 39 via retaining pins 40.

Figure 3:
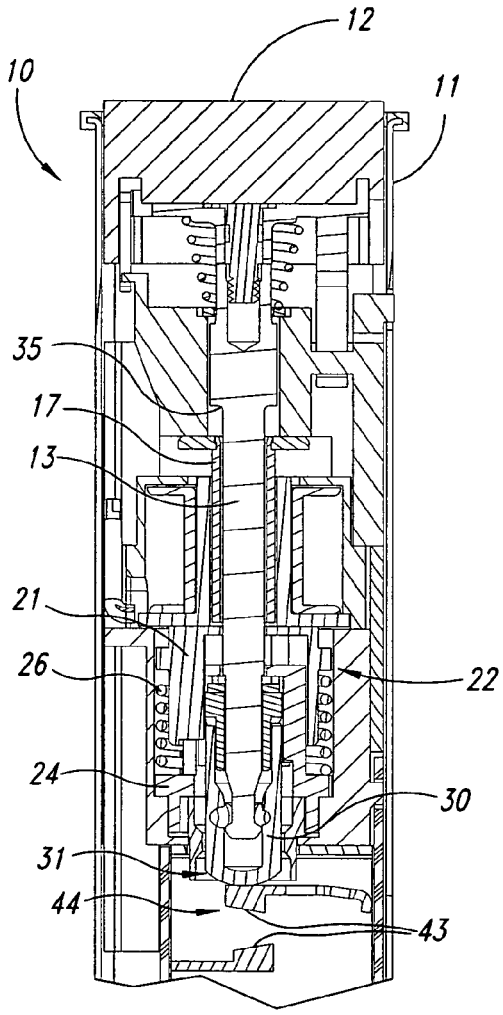
FIG. 3 is a cross-sectional elevational view of a switch provided in accordance with the present invention, illustrating a switching mechanism in a first state.
Figure 4:
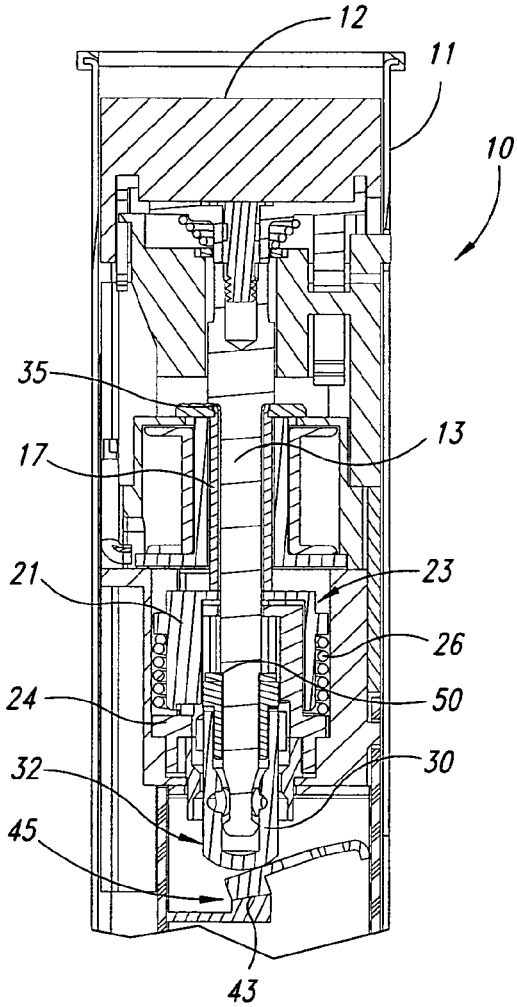
FIG. 4 is a cross-sectional elevational view of the switch of FIG. 3, illustrating the switching mechanism in a second state.

More particularly, as illustrated in FIGS. 3 and 4, a biasing member, for example solenoid 16, is coupled to the cap assembly 11 and actuation assembly 15. Solenoid 16 is coupled to a source of power, not shown, and is selectively activated and deactivated by supplying power to the solenoid and stopping the supply of power to the solenoid, respectively. When power is provided to the solenoid 16 and a push button 12 provided on the cap assembly 11 is depressed by a user, a flange 35 provided in cap assembly 11 that is in contact with a plunger 17 of solenoid 16, exerts a downward force on the plunger 17, thereby moving the plunger 17 from a first deactivated position 18 to a second activated position 19.

Figure 5A:
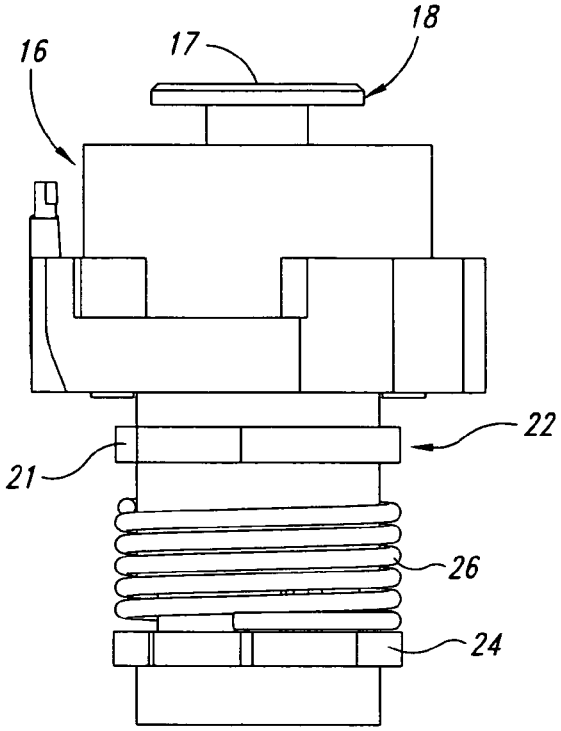
FIGS. 5A and 5B are side elevational views of a portion of the actuation assembly of FIG. 2, showing a biasing member in a first position and a second position, respectively.
Figure 5B:
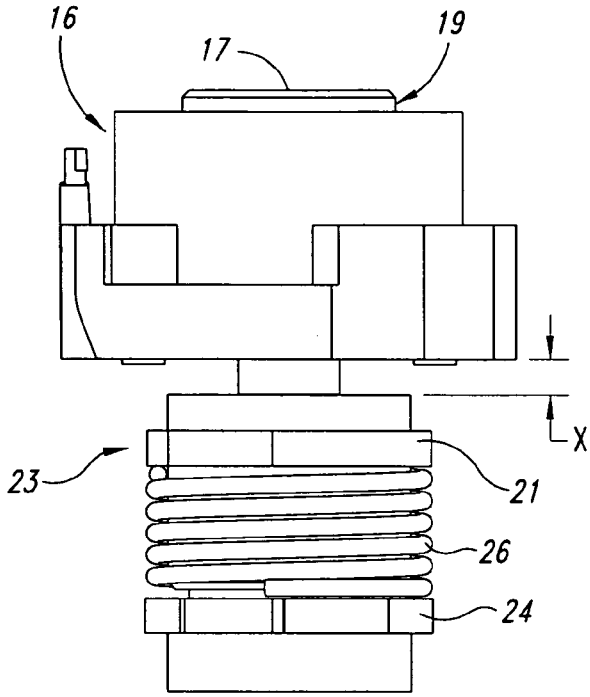

As the plunger 17 of solenoid 16 is seated from the first position 18 to the second position 19, the plunger 17 exerts a downward force on the translating cam 21, thereby moving the translating cam 21 by a distance X from a first position 22 to a second position 23, as best seen in FIGS. 5A and 5B. The plunger 17 of solenoid 16 holds the translating cam 21 in the second position 23, as illustrated in FIG. 4, as long as power is continuously supplied to the solenoid 16. When the supply of power to solenoid 16 ceases, plunger 17 returns from the second position 19 to the first position 18, and spring 26 exerts an upward force to restore the translating cam 21 to its first position 22.

Figure 6A:
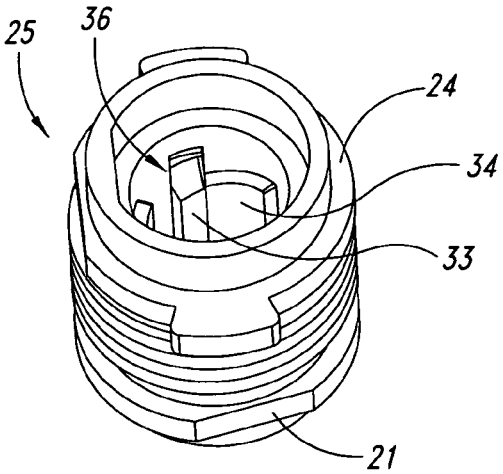
FIGS. 6A and 6B are bottom perspective views of a sleeve provided in accordance with the present invention, illustrating teeth and associated caming surfaces in a first position and a second position, respectively.
Figure 6B:
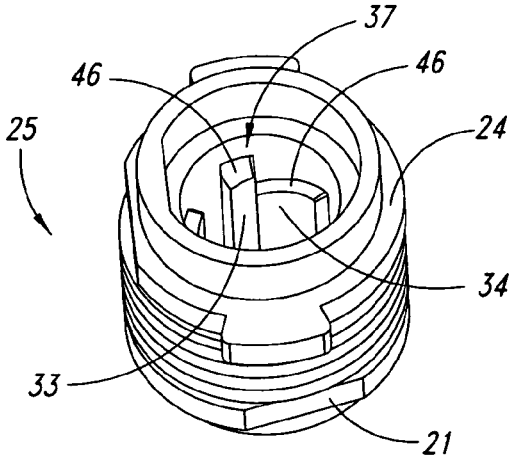
Figure 7:
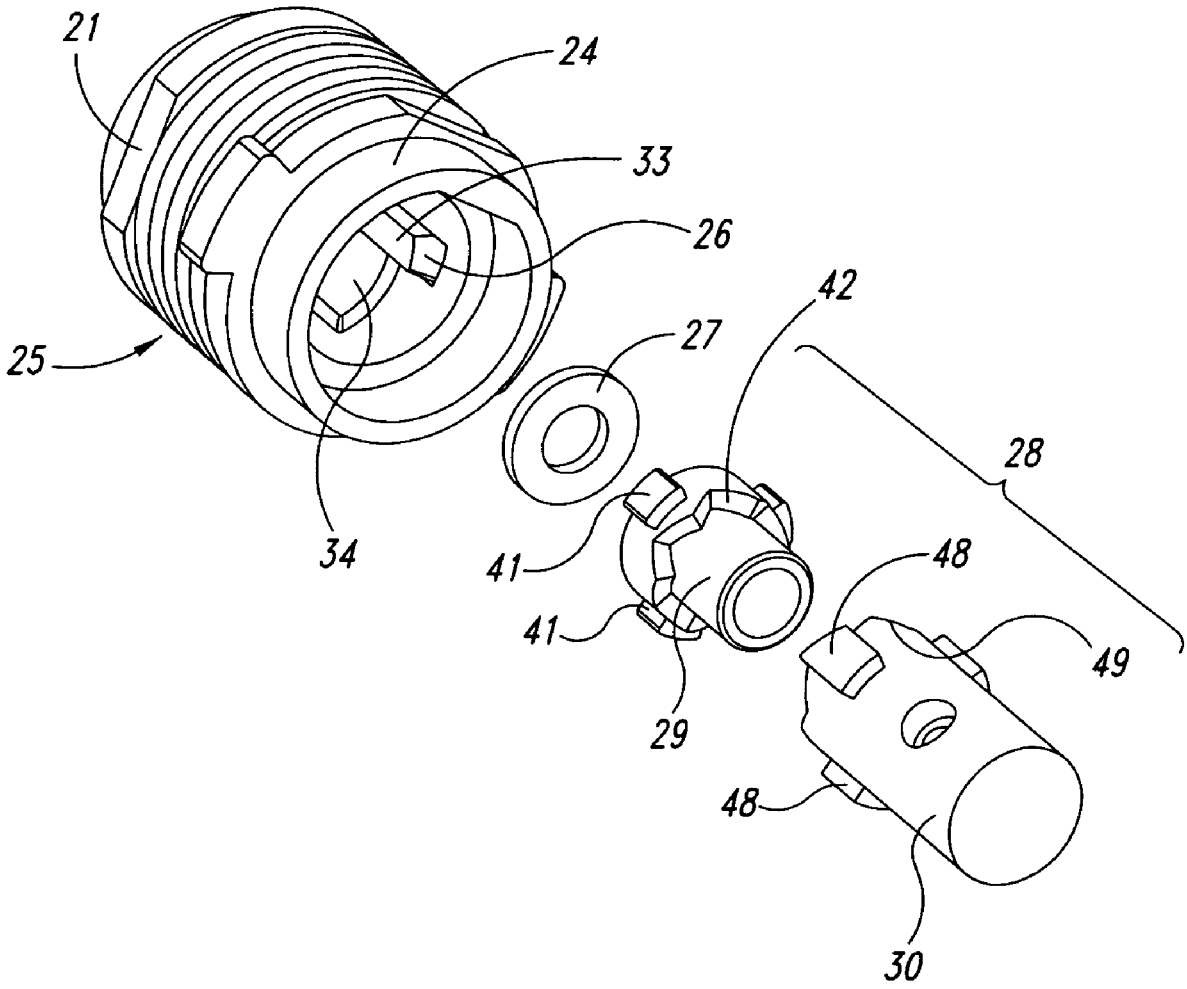
FIG. 7 is a partially exploded isometric view of several elements of the actuation assembly of FIG. 2.

While the translating cam 21 is held in position adjacent the stationary cam 24, the translating cam and stationary cam form a sleeve 25, in which a cam assembly 28 is positioned, as illustrated in FIGS. 3, 4 and 7. As best seen in FIGS. 6A-6B, a plurality of teeth 33 are provided on an inner surface of the translating cam 21, the teeth 33 moving from a first position 36 to a second position 37 within grooves 47 provided in stationary cam 24 when the translating cam 21 moves from its first position 22 to its second position 23. Conversely, when the supply of power to solenoid 16 ceases, and the translating cam 21 returns from the second position 23 to the first position 22, the teeth 33 provided in the translating cam return from their second position 37 to their first position 36. While in the second position 37, the teeth 33 are in a position relative to a plurality of teeth 34 provided on an inner surface of the stationary cam 24, to provide an operable set of caming surfaces 46 along which cam assembly 28 moves to cycle the switch between a first state and a second state.

More particularly, as illustrated in FIG. 7, cam assembly 28 includes a guide cam 29 and actuating cam 30. The guide cam 29 is provided with a plurality of external teeth 41 that are received within the sleeve 25, thereby allowing linear motion of the guide cam 29 while preventing rotational movement. A plurality of internal teeth 42 provided in a saw tooth pattern on the guide cam 29 engage a plurality of internal teeth 49 provided in a saw tooth pattern on actuating cam 30, to provide rotational movement to the actuating cam 30 when the guide cam 29 is depressed.

When a user depresses button 12, shaft 13 extends through a continuous bore formed through the various elements of the actuation assembly illustrated in FIG. 2, and a shoulder 50 provided on shaft 13 exerts a downward force on guide cam 29 via washer 27. As guide cam 29 is depressed, actuating cam 30 rotates and a plurality of external teeth 48 provided on actuating cam 30 move along the caming surfaces 46 provided in sleeve 25. The teeth 33 provided on the translating cam 21, when in their second position 37, act as a stop member for the teeth 48 provided on the actuating cam 30. As such, when the translating cam 21 is held in its second position 23 adjacent the stationary cam 24 to form sleeve 25, sleeve 25 functions as is known in the art and as described in U.S. Pat. No. 6,097,272, which patent is assigned to Korry Electronics Co., the Assignee of the present application, which patent is incorporated herein by reference in its entirety.

Cycling of the button 12 provided in the cap assembly 11 therefore mechanically moves the actuating cam 30 between a first position 31 and a second position 32, as illustrated in FIGS. 3 and 4, respectively. Motion of the actuating cam from the first position 31 to the second position 32 provides a corresponding change in a switching element 43 to which the actuating cam 30 is coupled. Therefore, mechanical actuation of the actuating cam 30 between the first position 31 and second position 32 provides a change in state of the switch 10 from a first state 44 illustrated in FIG. 3 to a second state 45 illustrated in FIG. 4. It will be understood that the exact nature of the switching element 43 may be any available configuration known in the art. Regardless of the form of switching element 43, the switching element 43 interacts with the actuating cam in such a way that the switching element 43, and thereby the switch 10, are cycled from a first state to a second state and vice versa with the corresponding movement and position of the actuating cam 30.

When the supply of power ceases to the solenoid 16, the teeth 33 provided in the translating cam 21 retract to their first position 36 as the translating cam 21 is returned to its first position 22. As such, the teeth 33 no longer serve to block motion of the external teeth 48 of actuating cam 30, such that actuating cam 30 rotates and retracts to its first position 31, thereby resetting the switch 10 to its first state 44.

Figure 8:
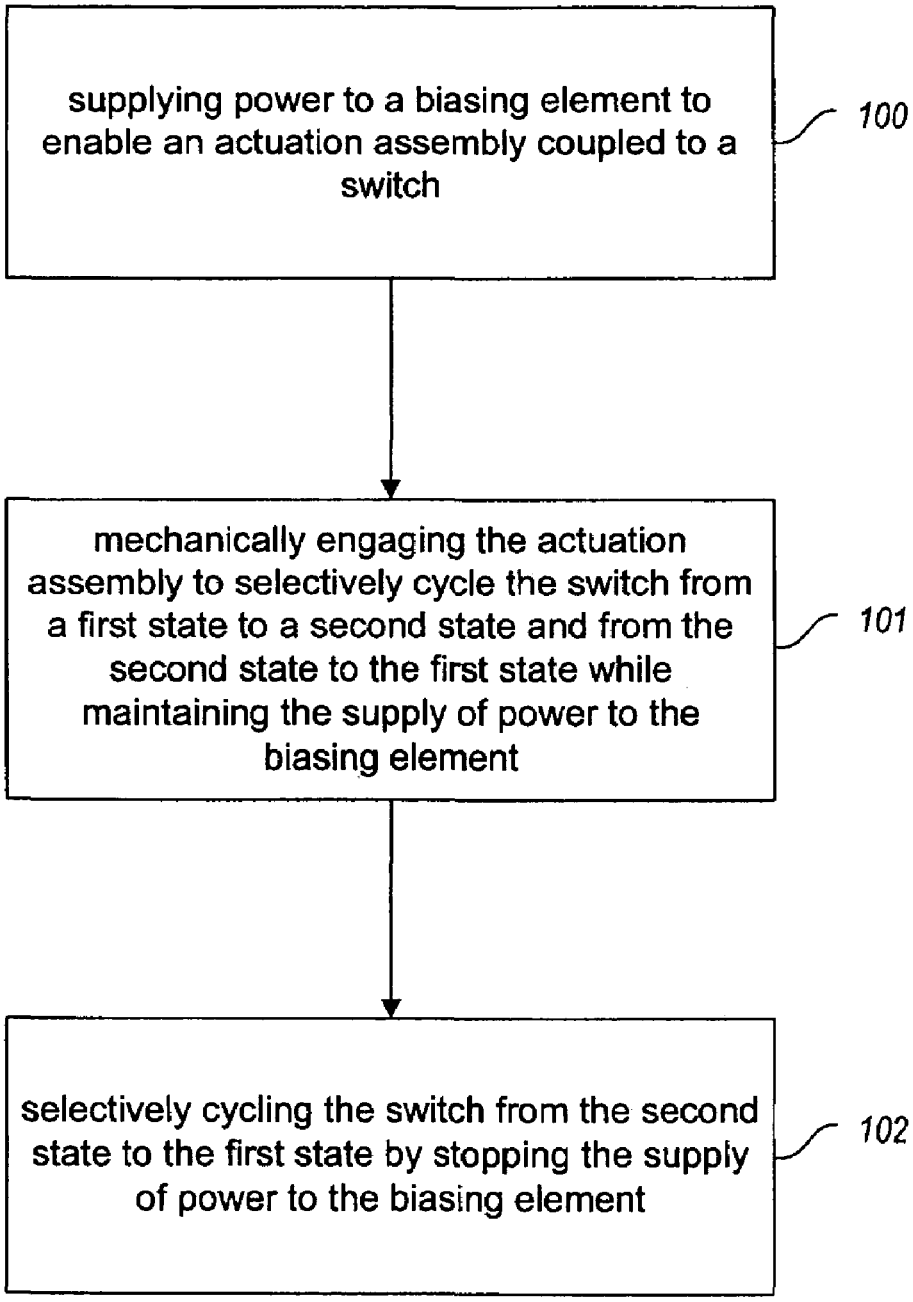
FIG. 8 is a diagram illustrating steps of an embodiment of the present invention.

As illustrated in FIG. 8, a switch may therefore be cycled between a first state and a second state by supplying power to a biasing element to enable an actuation assembly coupled to a switch, step 100. The actuation assembly may be selectively and mechanically engaged to cycle the switch from a first state to a second state and from the second state to the first state while maintaining the supply of power to the biasing element, step 101. The switch may also be selectively cycled from the second state to the first state by stopping the supply of power to the biasing element, step 102.

Figure 9:
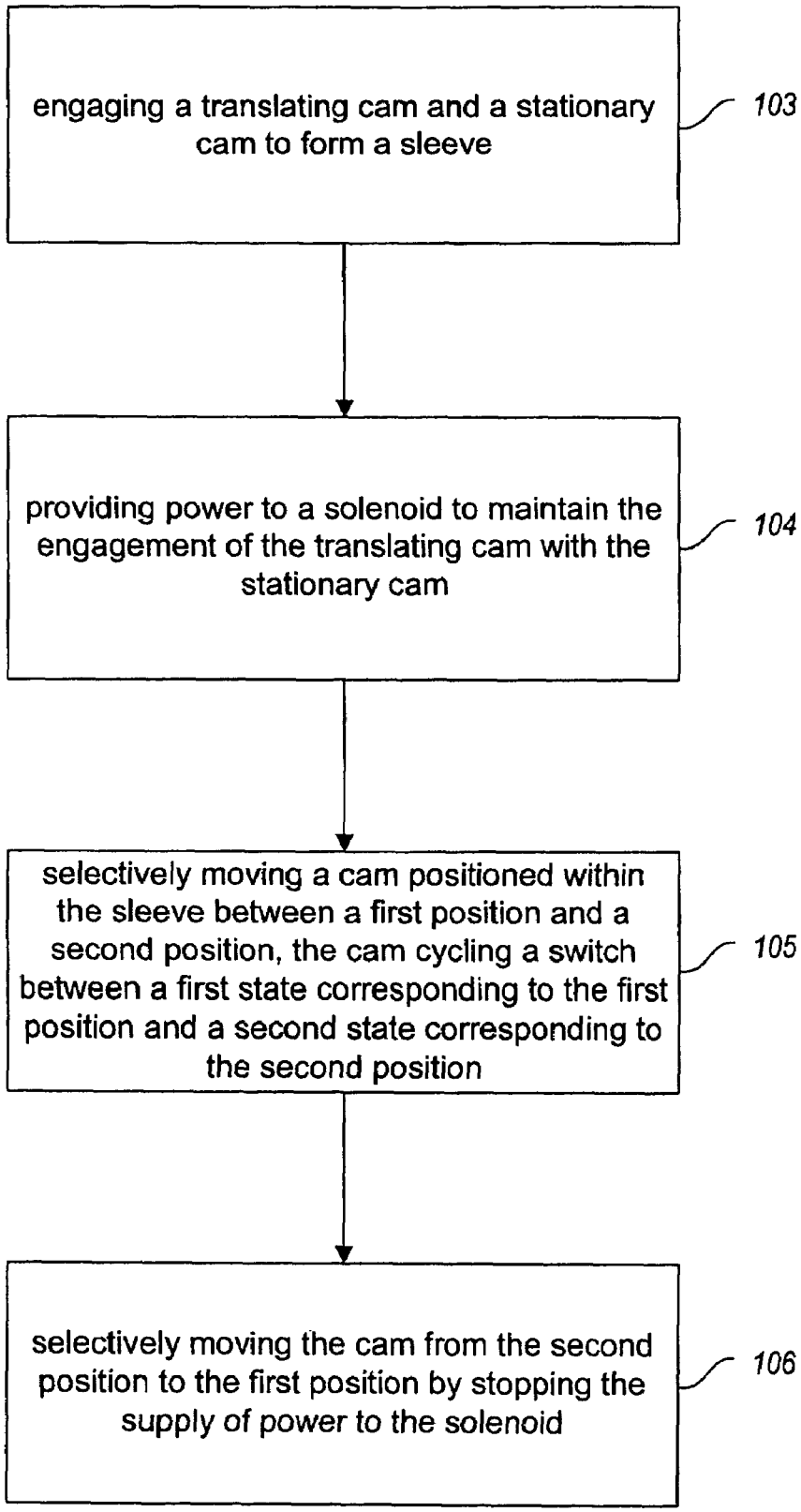
FIG. 9 is a diagram illustrating steps of an embodiment of the present invention.

In one embodiment, as illustrated in FIG. 9, this is accomplished by engaging a translating cam and a stationary cam to form a sleeve, step 103, and providing power to a solenoid to maintain the engagement of the translating cam and the stationary cam, step 104. A cam positioned within the sleeve is selectively moved between the first position and a second position, step 105, the cam cycling the switch between a first state corresponding to the first position and a second state corresponding to the second position of the cam. The cam is selectively moved from the second position to the first position by stopping the supply of power to the solenoid, step 106, thereby resetting the switch.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

The above description of illustrated embodiments, including what is described in the Abstract, is not intended to be exhaustive or to limit the invention to the precise forms disclosed. Although specific embodiments of and examples are described herein for illustrative purposes, various equivalent modifications can be made without departing from the spirit and scope of the invention, as will be recognized by those skilled in the relevant art.

The invention claimed is:

1. A switch assembly, comprising:

a sleeve having a first member that is selectively movable between a first position and a second position;

an electrical biasing member coupled to the sleeve, the electrical biasing member being selectively movable between a first deactivated position and a second activated position when the electrical biasing member is supplied with electrical power, the electrical biasing member holding the first member of the sleeve in the second position when the electrical biasing member is in the second activated position;

an actuator coupled to the sleeve and to a switch to selectively cycle the switch between a first state and a second state while the electrical biasing member is in the second activated position; and a cam assembly that engages a plurality of cam surfaces provided on the sleeve.

2. The switch assembly according to claim 1, wherein the biasing member comprises a solenoid.

3. The switch assembly according to claim 2 wherein the sleeve comprises a translating cam and a stationary cam, and a plunger of the solenoid is selectively engagable with the translating cam.

4. The switch assembly according to claim 1 wherein the actuator is configured to selectively cycle the switch between the first state and the second state when a button is moved by a user.

5. A switch assembly, comprising:

a translating cam and a stationary cam, the translating cam being selectively movable between a first position and a second position;

an electrical biasing member being selectively movable between a first deactivated position and a second activated position when the electrical biasing member is supplied with electrical power, the electrical biasing member holding the translating cam in the second position when the electrical biasing member is in the second activated position;

a plurality of teeth provided in an inner region of the translating cam, the teeth being in an operable position when the translating cam is in the second position;

a cam assembly coupled to the stationary cam and to a switch, the cam assembly being selectively engagable with the plurality of teeth when the teeth are in the operable position to cycle the switch between a first state and a second state; and wherein the switch is cycled between the first state and the second state when a user moves a button, and the switch is cycled from the second state to the first state when the electrical biasing member is moved from the second activated position to the first deactivated position.

6. The switch assembly, according to claim 5, wherein the biasing member is a solenoid.

7. The switch assembly according to claim 6 wherein a plunger of the solenoid is selectively engagable with the translating cam.

8. The switch assembly according to claim 5 wherein the cam assembly further comprises a guide cam and an actuating cam.

9. The switch assembly according to claim 5, further comprising:

a spring coupled to the translating cam, the spring exerting a force on the translating cam to restore the translating cam to the first position when the electrical biasing member moves to the first deactivated position.

10. The switch assembly according to claim 5, further comprising:

a cap that is depressible by a user, a shaft coupled to the cap engaging the cam assembly when the cap is depressed.

11. A switch assembly, comprising:

a sleeve having a first member that is selectively movable between a first position and a second position;

means for biasing the first member of the sleeve to the second position;

a switch coupled to the sleeve; and means for selectively cycling the switch between a first state and a second state while the first member of the sleeve is in the second position, the means for selectively cycling the switch comprising a cam assembly that engages a plurality of cam surfaces provided on the sleeve.

12. The switch assembly according to claim 11 wherein the means for biasing the first member of the sleeve is magnetic.

13. The switch assembly according to claim 11, further comprising:

means for selectively activating and deactivating the biasing means.

14. The switch assembly according to claim 13, further comprising:

an actuator coupled to the switch, the actuator being operable to cycle the switch between the first state and the second state when the biasing means is activated.

15. A method for changing a state of a switch, comprising:

supplying electrical power to a biasing element to enable an actuation assembly coupled to a switch;

mechanically engaging the actuation assembly to selectively cycle the switch from a first state to a second state and from the second state to the first state while maintaining the supply of electrical power to the biasing element; and selectively cycling the switch from the second state to the first state by stopping the supply of electrical power to the biasing element.

16. The method according to claim 15, further comprising:

moving a first portion of a cam unit from a first position to a second position, the first portion of the cam unit being held in the second position by the biasing element.

17. The method according to claim 15, further comprising:

selectively cycling the switch between the second state and the first state by actuating a button.

18. The method of claim 15, wherein mechanically engaging the actuation assembly includes moving a depressible button coupled to the actuation assembly.

19. A method for changing a state of a switch, comprising:

supplying electrical power to a biasing element;

engaging a stationary cam with a translating cam to form a sleeve;

maintaining the engagement of the translating cam with the stationary cam by continuing to supply electrical power to the biasing element; and selectively moving a cam positioned within the sleeve and coupled to a switch between a first position and a second position while maintaining the engagement of the translating cam with the stationary cam.

20. The method according to claim 19, further comprising:

selectively disengaging the translating cam from the stationary cam.

21. The method according to claim 20, further comprising:

stopping the supply of power to the biasing element.

22. A method for changing a state of a switch, comprising:

engaging a translating cam and a stationary cam to form a sleeve;

providing power to a solenoid to maintain the engagement of the translating cam with the stationary cam;

selectively moving a cam positioned within the sleeve between a first position and a second position while continuing to provide power to the solenoid, the cam cycling a switch between a first state corresponding to the first position and a second state corresponding to the second position; and selectively moving the cam from the second position to the first position by stopping the supply of power to the solenoid.

23. The method according to claim 22, further comprising:

actuating a button to selectively move the cam from the second position to the first position.

24. The method according to claim 22, wherein the supply of power to the solenoid is stopped when a vehicle in which the switch is installed is powered down.

* * * * *